United States Patent [19]

Kiesling

[11] Patent Number: 4,940,434

[45] Date of Patent: Jul. 10, 1990

[54] MARINE PROPULSION UNIT UNIVERSAL DRIVE ASSEMBLY WITH THROUGH-BELLOWS EXHAUST

[75] Inventor: Douglas A. Kiesling, Oshkosh, Wis.

[73] Assignee: Brunswick Corporation, Skokie, Ill.

[21] Appl. No.: 297,947

[22] Filed: Jan. 17, 1989

[51] Int. Cl.[5] ..... B63H 25/42

[52] U.S. Cl. ..... 440/57; 440/89

[58] Field of Search ..... 440/53, 54, 57, 58, 440/88, 89, 112, 900

[56] References Cited

U.S. PATENT DOCUMENTS

| | | | |
|---|---|---|---|
| 3,136,285 | 6/1964 | Kiekhaefer . | |
| 3,181,495 | 5/1965 | Kiekhaefer | 440/89 |
| 3,847,108 | 11/1974 | Shimanckas | 440/57 |
| 4,178,873 | 12/1979 | Bankstahl | 440/89 |
| 4,201,391 | 5/1980 | Bankstahl . | |
| 4,289,488 | 9/1981 | Weronke et al. | 440/57 |

OTHER PUBLICATIONS

"L-Drive", Jan., 1989 issue of Boating magazine, pp. 184–197.

*Primary Examiner*—Sherman D. Basinger
*Assistant Examiner*—Stephen P. Avila
*Attorney, Agent, or Firm*—Andrus, Sceales, Starke & Sawall

[57] ABSTRACT

A marine propulsion device (11) is provided wherein a pair of generally telescoped bellows (31; 38,46) surround the universal joint (18) and provide an exhaust passage (44) therebetween which communicates between the inboard engine (9) and the stern drive unit (2). In the embodiment disclosed herein, the inner bellows (31) rotates with the universal joint while the outer bellows (38,46) is stationary. The bellows are preferably of helical or spiral configuration and the rotating inner bellows forms an exhaust pump. In one embodiment, (FIGS. 1–3), the bellows (31,38) are concentrically disposed, while in another embodiment (FIGS. 4–5) the bellows (31,46) are eccentrically mounted.

7 Claims, 3 Drawing Sheets

1
2
3
4
5
6
7
8
9
10
11
12
13
14
15
16
17
23
26
28
29
31
36
37
38
44
45

3
6
10
13
18
19
20
23
24
25
26
27
30
31
32
33
34
35
36
37
38
39
40
41
42
43
44
45

MARINE PROPULSION UNIT UNIVERSAL DRIVE ASSEMBLY WITH THROUGH-BELLOWS EXHAUST

BACKGROUND AND SUMMARY OF THE INVENTION

This invention relates to a marine propulsion unit drive assembly, and more particularly to an arrangement utilizing circumferential bellows encircling the universal drive coupling which permits all-direction pivoting of a stern drive unit.

It is known to provide a flexible bellows around the universal joint connecting a marine stern drive unit to an inboard engine. See, for example, U.S. Pat. 3,136,285 and 4,201,391. In the latter patent, a bellows is attached to a stationary tubular extension on the gimbal ring housing. Reference is also made to the co-pending U.S. application by Daniel F. McCormick, Ser. No. 07/228,320, filed Aug. 4, 1988, entitled "Marine Propulsion Unit Universal Drive Assembly," and assigned to a common assignee. In the co-pending application, the bellows is attached to and rotates with the universal joint.

In the prior known devices, the inboard engine enhaust is transferred through one or more passages disposed substantially below the universal drive assembly and hence to the stern drive unit itself for subsequent discharge, such as through the propeller. See for example the aforementioned U.S. Pat. No. 4,201,391. This method of exhaust discharge is space consuming.

It is an object of the present invention to essentially reduce the space taken up by the known exhaust arrangements adjacent the universal drive assembly, to make room for other mechanism, such as an improved trim system.

In accordance with the various aspects of the invention, a marine propulsion device is provided wherein a pair of generally telescoped bellows surround the universal joint and provide an exhaust passage therebetween which communicates between the inboard engine and the stern drive unit. In the embodiment disclosed herein, the inner bellows rotates with the universal joint while the outer bellows is stationary. The bellows are preferably of helical or spiral configuration and the rotating inner bellows forms an exhaust pump. In one embodiment, the bellows are concentrically disposed, while in another embodiment the bellows are eccentrically mounted.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENTS

Figure 1:
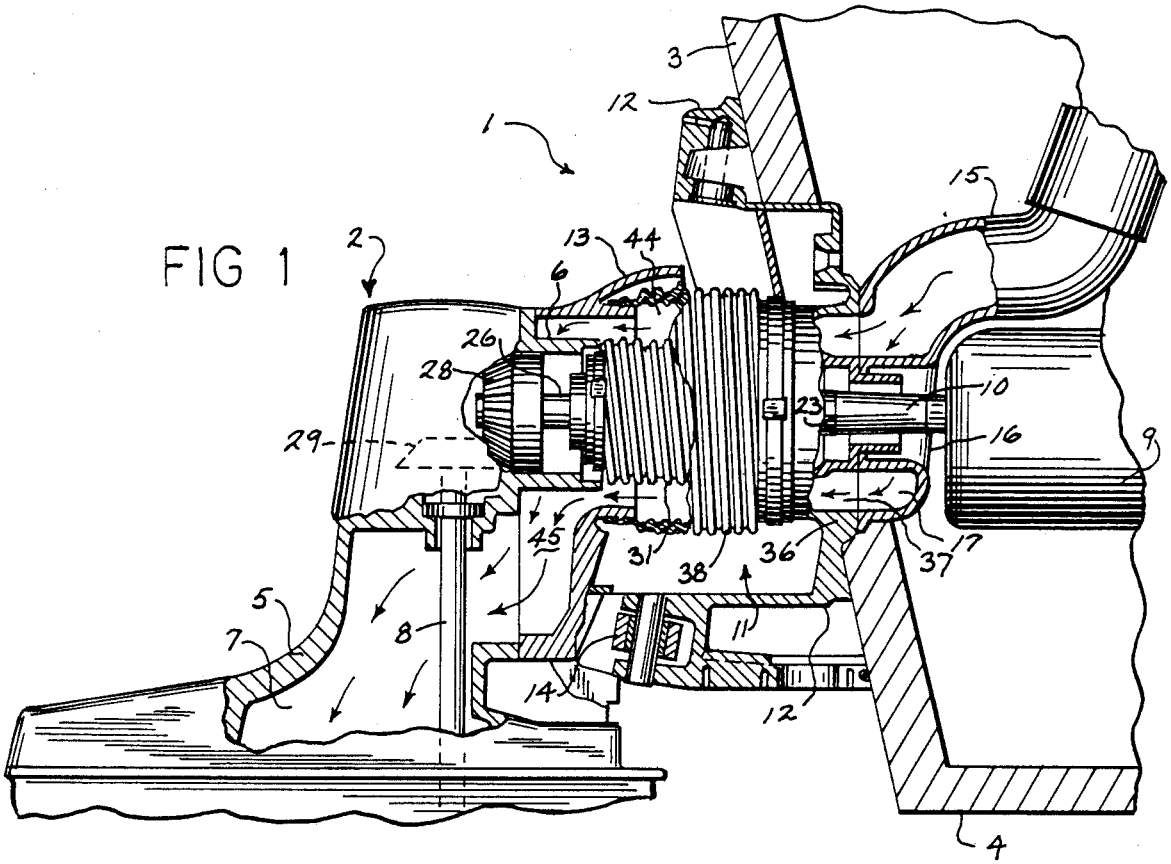
FIG. 1 is a side elevation, with parts broken away and in section, of a marine stern drive unit incorporating the various aspects of the invention.

As shown in the drawings, the aspects of the invention are adapted to be incorporated in a marine propulsion unit 1 including a stern drive unit 2 mounted to the transom 3 of a boat 4. Stern drive unit 2 generally includes a stern drive housing 5 having a forwardly extending cylindrical projection 6, and forming a chamber 7 through which vertically extends a main drive shaft 8 adapted to drive the unit's propeller means, not shown. An inboard mounted internal combustion engine 9 is provided with a rearwardly extending output shaft 10 in the usual manner. Shaft 10 is interconnected through a universal drive assembly 11 to stern drive unit 2.

A transom mounting bracket 12 secures stern drive unit 2 to transom 3. Bracket 12 also includes an opening through which the connecting drive extends. Stern drive housing 5 has secured thereto a bell housing 13 which in turn is pivotally mounted to a gimbal ring 14 which is also pivotally mounted in the usual manner.

Heretofore, the engine exhaust was conducted through a separate tubular conduit passing through the transom and below universal drive assembly 11. In the present instance, the inboard engine exhaust discharge pipe 15 terminates in a stationary ring-like member 16 at the inner side of transom 3 and which forms a rearwardly facing annular chamber 17. Member 16 is generally coaxial with engine output shaft 10, which passes through the member.

Universal drive assembly 11 includes a universal joint 18 of usual construction which constitutes, in part, a forward yoke 19 and a rearward yoke 20 which are joined to a rotatable intermediate member, commonly called a cross 21, with cross 21 having two pair of opposed cross arms 22. Forward yoke 19 includes a central yoke shaft 23 which extends forwardly through an annular bearing 24 and hence is coupled to engine output shaft 10. The rearward end of yoke shaft 23 merges into a forked pair of yoke arms 25. Likewise, rearward yoke 20 includes a central yoke shaft 26 which is generally coaxial with yoke shaft 19, on a common drive axis 27. Shaft 26 extends rearwardly through projection 6 of housing 5, and is provided at its rearmost end with a gear 28 which meshes with a pinion 29 disposed on the upper end of main drive shaft 8. The forward end of yoke shaft 26 merges into a forked pair of yoke arms 30.

Rotation of forward yoke shaft 23 causes rotation of universal joint 18, and ultimately rotation of rearward yoke shaft 26 to drive main drive shaft 8.

Figure 2:
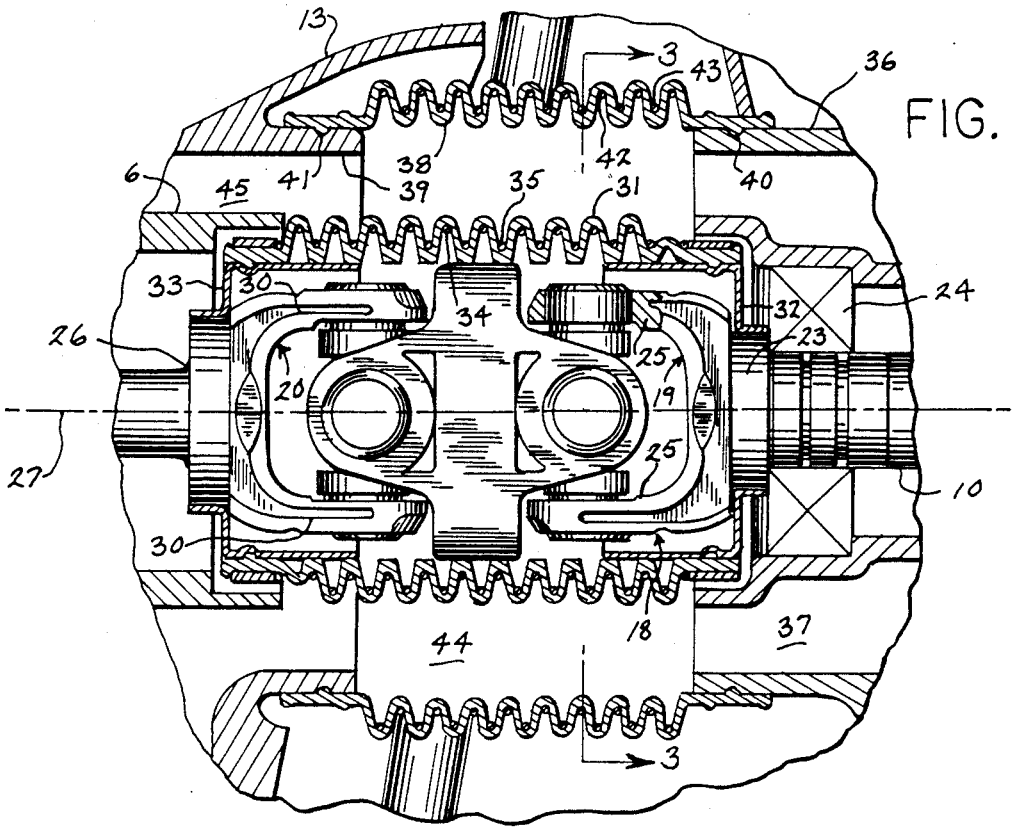
FIG. 2 is an enlarged side elevation, with parts broken away and in section, of the universal joint connection for the stern drive unit.

As best shown in FIG. 2, an annular protective flexible convoluted helical bellows 31 is disposed about universal joint 18 and, in the present embodiment, is mounted so as to rotate with the latter. The mounting is described in detail in the aforementioned co-pending U.S. patent application Ser. No. 07/228,320, the entire disclosure of which is incorporated herein by reference. Briefly, the ends of bellows 31 are clampingly attached to fore and aft end caps 32,33 which are mounted for rotation with the respective fore and aft yoke shafts 23 and 26 of universal joint 18. In addition, a helical wire spring 34 is mounted internally of the convolutions of bellows 31 to keep the bellows from flattening out under certain operating conditions. Furthermore, a helical wire spring 35 is wound around the outside of bellows 31 and disposed in the valleys of the convolutions thereof. Spring 35 restrains bellows 31 from enlargement due to centrifugal forces arising during rotation.

In accordance with certain aspects of the invention, means are provided to create an engine exhaust passageway through the bellows area between engine 9 and stern drive unit 2. For this purpose, mounting bracket 12 is formed at a portion of its forward end in the shape of a rearwardly projecting stationary ring 36 which abuts ring 16. Ring 36 forms a forwardly facing annular chamber 37 which communicates rearwardly from and forms a continuation of chamber 17.

As best shown in FIG. 2, a second annular protective flexible convoluted helical bellows 38 is disposed in telescoping relation with and having a wall spaced outwardly from the wall of bellows 31. The forward end of bellows 38 is fixedly mounted to the outer wall of ring 36, and the rearward bellows end is fixedly mounted to an annular wall 39 in bell housing 13, as by respective groove-and-projection arrangements 40 and 41. Bellows 38 is shown as being provided with inner and outer wire support springs 42,43 similar to springs 34 and 35. The resultant construction creates an annular passage or chamber 44 between first and second bellows 31 and 38 and which surrounds universal joint 18 and forms a rearward continuation of chamber 17. Bell housing wall 39 forms part of a chamber 45 which communicates with stern drive unit housing chamber 7.

When inboard engine 9 is operating, its exhaust travels as shown by the arrows in FIG. 2, that is, through pipe 15 and hence through chambers 17, 37, 44 and 45 into stern driven unit 2 for subsequent discharge.

By constructing inner bellows 31 in the form of a helix, rotation thereof during stern drive operation creates a pumping action to pump the engine exhaust through chamber 44.

Figure 3:
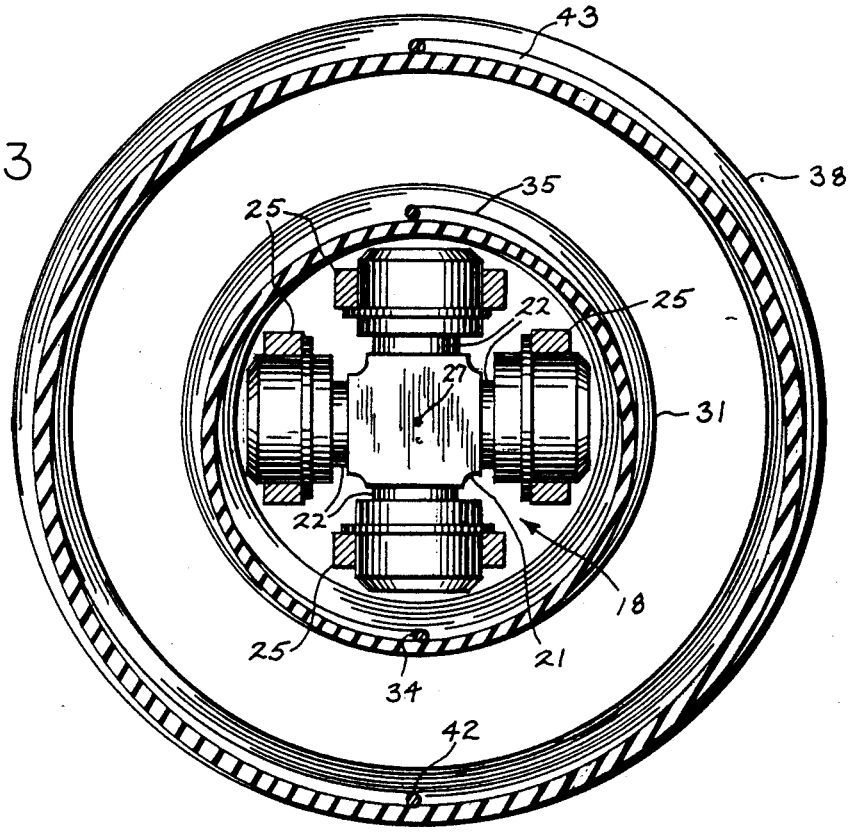
FIG. 3 is a vertical section taken on line 3—3 of FIG. 2.
Figure 5:
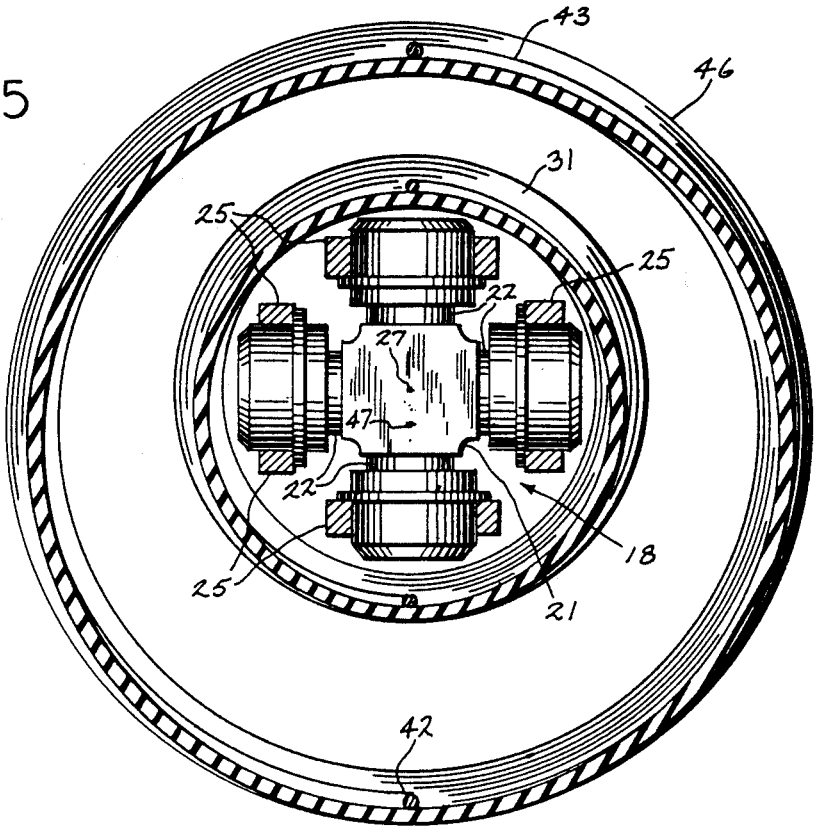
FIG. 5 is a vertical section taken on line 5—5 of FIG. 4.
Figure 4:
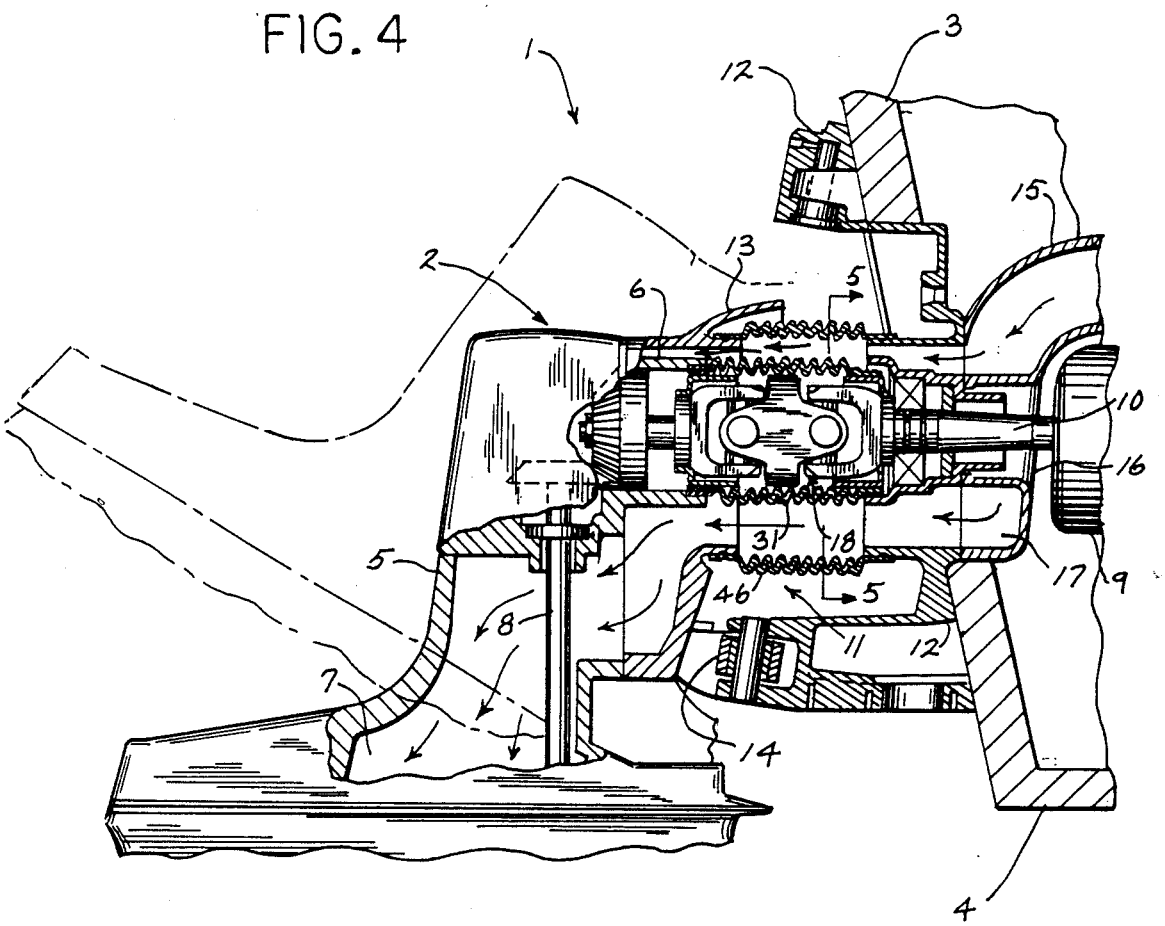
FIG. 4 is a view generally similar to FIG. 1 and showing a second embodiment of bellows placement.

The embodiment of FIGS. 1–3 illustrates a construction wherein bellows 31 and 38 are concentrically mounted coaxially about drive axis 27. In some instances, it may be beneficial when in tilt mode (see FIG. 4) to dispense with the concentricity. FIGS. 4 and 5 illustrate a second embodiment which in many respects is simlar to the first embodiment, except that in this instance the second or outer bellows 46 is mounted on an axis 47 offset downwardly from drive axis 27 so that outer bellows 46 is eccentric to the inner bellows 31, thus providing a variable restriction in the passage when viewed in section.

The aspects of the invention provide a unique through-the-bellows engine exhaust arrangement which is not only efficient in operation, but which also conserves space for other uses Various modes of carrying out the invention are contemplated as being within the scope of the following claims, which particularly point out and distinctly claim the subject matter of the invention.

I claim:

1. A universal drive assembly (11) for connecting the rotary output (10) of an inboard marine engine (9) having an exhaust discharge element (15) to a rearwardly disposed outboard mounted stern drive unit (2), comprising, in combination:

(a) a universal joint (18) rotatable about a drive axis (27) and adapted for respective connection to the engine and stern drive unit, (b) and exhaust passage means (44) surrounding said universal joint and connected to carry exhaust from the engine exhaust discharge element to the stern drive unit.

2. The combination of claim 1 in which said exhaust passage means (44) is formed by a pair of generally cylindrical telescopingly disposed inner and outer bellows (31;38,46).

3. The combination of claim 2 in which said inner bellows (31) is mounted for rotation with said universal joint.

4. The combination of claim 3 which includes means (36,39) fixedly mounting said outer bellows (38,46) against rotation relative to said drive axis (27).

5. The combination of claim 3 in which said inner bellows (31), when rotating, forms pump means for pumping engine exhaust through said passage means (44).

6. The combination of claim 2 in which said inner and outer bellows (31,38) are disposed generally concentrically to said drive axis (27).

7. The combination of claim 2 in which:

(a) one of said bellows (31) is disposed generally coaxial with said drive axis (27), (b) and the other of said bellows (46) is disposed on a second axis (47) which is offset from said drive axis.

* * * * *